United States Patent [19]

Sedlaczek et al.

[11] 4,234,234

[45] Nov. 18, 1980

[54] DRIVING DEVICE FOR A MINING MACHINE

[75] Inventors: Janusz Sedlaczek, Gliwice; Andrzej Błażewicz, Tychy; Jacek Cyrułło, Sosnowiec; Marian Krutki; Tadeusz Woźniak, both of Katowice, all of Poland

[73] Assignee: Centralny Osrodek Projektowo-Konstrukcyjny Maszyn Gorniczych Komag, Gliwice, Poland

[21] Appl. No.: 16,028

[22] Filed: Feb. 28, 1979

[30] Foreign Application Priority Data

Mar. 15, 1978 [PL] Poland ..... 205358

[51] Int. Cl.[3] ..... E21C 29/02

[52] U.S. Cl. ..... 299/43; 105/29 R

[58] Field of Search ..... 105/29 R; 299/34, 42, 299/43

[56] References Cited

U.S. PATENT DOCUMENTS 4,099,786 7/1978 Nakajima et al. ..... 299/43

FOREIGN PATENT DOCUMENTS 1215631 5/1966 Fed. Rep. of Germany ..... 299/43

*Primary Examiner*—Ernest R. Purser

*Attorney, Agent, or Firm*—Haseltine, Lake & Waters

[57] ABSTRACT

The invention solves a problem of transferring the combine weight onto a conveyor through a railing, instead of through a link chain.

For the aforesaid purpose a slide skid is provided, at both sides, with riding wheels. During operation of the combine the riding wheels roll on a railing; the riding wheels are mounted in a slide skid on a cranked axle. The cranked axle is protected against turning by means of a cover provided with a splined hole fixed on a splined pin of the cranked axle. The cover is fixed to the slide skid by means of screws.

The design of the present device prevents deformation and tightening of vertical links of a chain between a rack and a slide skid in case of fouling of the rack with fine coal.

4 Claims, 3 Drawing Figures

DRIVING DEVICE FOR A MINING MACHINE

The subject of the invention is a driving device for a mining machine advancing on a conveyor, especially for a combine.

A device for driving a mining machine, especially a combine advancing on a longwall conveyor, is known from the prior art. Said device is mounted into a combine and consists of a drive sprocket-wheel, a reversible wheel, and directing wheels. Said wheels are fixed to the combine. An endless link chain is wound upon the said wheels, one section of the said chain being situated parallely to a conveyor and held in such position by a deflecting block, i.e. by a slide skid. The section of the chain supported by the deflecting block meshes with a rack situated alongside of the conveyor, on one of the shelves of the conveyor, the said teeth having a shape adapted for co-operation with a link chain. The reversible drive wheels and the directing wheels are toothed as well, their teeth being adapted for co-operation with the link chain. The drive wheel which is driven by the motor of the combine makes, while rotating, the link chain rewind through the reversible wheel and the directing wheel, and said chain section co-operating with the rack fixed alongside the conveyor makes the combine advance along the conveyor, as it is in crawlers. A railing of a circular section is attached to the whole length of the conveyor. A slide is fixed with screws to the flat surface of the combine, said slide having, from the side of the conveyor, a circular recess which encloses the railing. The combine advancing on the conveyor is protected against falling off the conveyor by means of a slide enclosing at least half of the railing diameter. In the section in which the link chain meshes with the rack it is guided from above by means of the deflecting block, i.e. by the slide skid whose surface is parallel to the rack.

The disadvantage of the known device is that during operation the intertooth spaces of the rack are filled with fine coal and consequently the chain is raised, meeting the slide skid from above. At a certain state of the intertooth spaces being filled with fine coal, the weight of the combine is transferred onto the rack by means of the chain, instead of being transferred onto the railing by means of the slide. Then vertical links of the chain are loaded with the combine weight and are held down to the rack by means of the slide skid, and consequently are deformed and abraded at their surfaces contacting the slide skid. In consequence, the chain is worn, and first of all its links are decalibrated which impedes meshing of the chain with the drive wheel and the reversible wheel, thus disturbing the fluency of co-operation between the link chain and all elements with which it meshes. Notwithstanding the fact that the driving device is provided with scrapers to clean the rack, nevertheless their operation is of low efficiency and does not prevent completely fouling of the rack.

The object of the invention is a device in which combine weight is transferred onto a conveyor by means of a chain, instead of by means of a railing.

The aforesaid object has been achieved by means of mounting of two riding wheels at one side of the combine, the combine rolling on the said wheels along the railing. Along the opposite edge the combine slides on the conveyor. The said wheels are fixed in the body of the combine on cranked axles, thus—by means of rotating the axle fixed in the combine body—the riding wheels can be lowered or raised in relation to the combine body. As the riding wheels do not protect the combine against falling off the railing, a guide with a circular recess is fixed to the combine between the wheels. The radius of the circular recess is bigger than the radius of the railing, which enables changing of the position of the wheels, and at the same time protects the combine against falling off the conveyor, in case of bigger deflections of the combine from the required position.

The device according to the invention is presented in an example of realisation in the drawing, where FIG. 1 illustrates the side view of the device;

Figure 1:
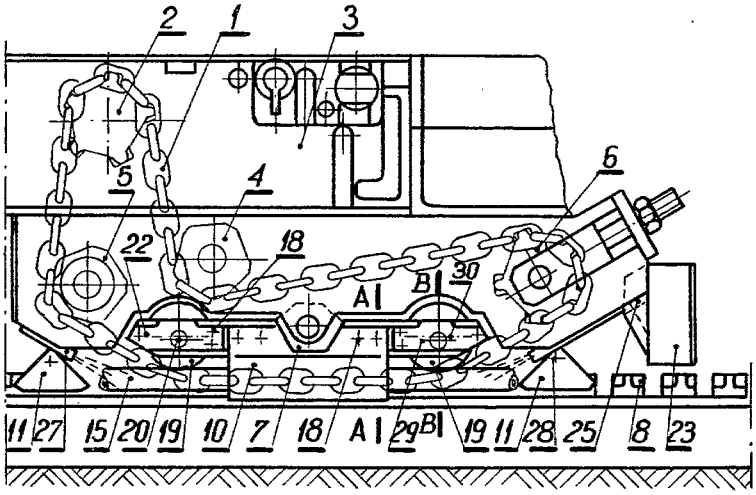
Figure 2:
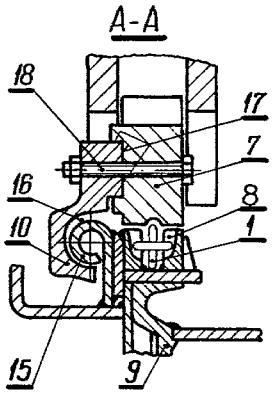
FIG. 2 illustrates the section of the device made by the plane designated in FIG. 1.
Figure 3:
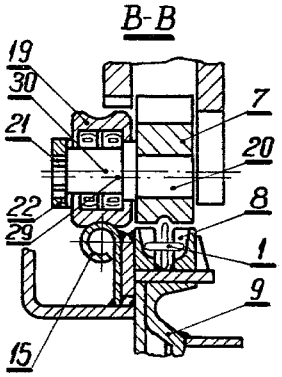
FIG. 3 illustrates a cross-section of the device made by the plane intersecting the riding wheels designated in FIG. 1 as B—B.

A combine 3 includes a drive wheel 2 and a reversible wheel 6. Between said wheels a link chain 1 runs whose direction is controlled by directing wheels 4 and 5. At a certain section the link chain 1 slides on a slide skid 7 fixed to the combine 3. Said slide skid 7 is provided with a tubular slipper 10. Said tubular slipper 10 encloses a railing 15 situated in gates of a conveyor 9 close to a rack 8. The tubular slipper 10 is provided with longitudinal recesses 16. Due to this forces acting upon the tubular slipper 10 during operation of the combine 3 are transferred by resistance planes of the groove 17, and not by screws 18. Said screws 18 protect only the protrusion of the slipper 10 against slipping out of the groove 17. The slide skid 7 is provided, at both sides, with riding wheels 19. When the combine 3 is in operation, the riding wheels 19 roll on the railing 15. Said riding wheels 19 are mounted in the slide skid 7 on a cranked axle 20 whose axis is designated as 30 in the drawing. Said cranked axle 20 is protected against rotation by means of a cover 22 provided with a splined hole in a splined pin 21 of the cranked axle 20. Said cover 20 is fixed to the slide skid 7 by means of screws 18. A required distance between the slide skid 7 and the rack 8 is set by turning the axle 20 and locking it in a required position by means of the cover 22. Due to the above manipulations tightening and deformation of vertical links of the chain are eliminated. A sweeper 23 is fixed in the front part of the combine 3, said sweeper 23 being provided with a bracket 25 leaning against the lower surface of the slide of the combine 3. Besides, the slides of the combine 3 are provided with cleaning nozzles 27 removing impurities from the rack 8 by means of compressed water, as well as, with scrapers 11 hinged on a pin 28.

What is claimed is:

1. An improved device for driving a mining machine which shifts on a conveyor, especially for driving a combine, said device being comprised of, an endless link chain, said chain being extended between a toothed drive wheel and a toothed reversible wheel which are fixed to a combine; a rack fixed alongside the conveyor, said rack is in mesh with said chain and maintained in said mesh by means of a slide skid provided with riding wheels at both its ends; a slipper, said slipper being fixed to the combine and provided with a circular recess enclosing a railing fixed to said conveyor along its whole length, said improvement comprising: having the riding wheels mounted on cranks of axles fixed in the combine, and being provided with recess means formed in the slipper, said recess being larger than the outer dimensions of the railing.

2. An improved device according to claim 1, wherein said improvement comprises: having said axle beyond its crank of a geommetrical axis provided with a splined pin co-axial with a geommetrical axis of the axle, and having a cover with a splined hole fixed onto the splined pin, said cover being fixed to the combine by means of fixing elements.

3. An improved device according to claim 2, wherein said improvement comprises: having said riding wheels situated in the area of the ends of the section of the link chain meshing with the rack to enable said riding wheels to roll on the railing.

4. A device according to claim 1, characterized in that, a cranked axle is fixed in a slide skid.

* * * * *